US009242457B2

(12) United States Patent
Yasuzaki

(10) Patent No.: US 9,242,457 B2
(45) Date of Patent: Jan. 26, 2016

(54) CONTROL APPARATUS, CONTROL METHOD, AND PROGRAM

(71) Applicant: CANON KABUSHIKI KAISHA, Tokyo (JP)

(72) Inventor: Koji Yasuzaki, Tokorozawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/579,976

(22) Filed: Dec. 22, 2014

(65) Prior Publication Data

US 2015/0183214 A1 Jul. 2, 2015

(30) Foreign Application Priority Data

Dec. 26, 2013 (JP) ..... 2013-269675

(51) Int. Cl.
*B41J 29/38* (2006.01)
*B41J 29/393* (2006.01)
*B41J 2/045* (2006.01)

(52) U.S. Cl.
CPC ..... *B41J 2/04505* (2013.01)

(58) Field of Classification Search
USPC ..... 347/9, 16, 19
See application file for complete search history.

(56) References Cited

U.S. PATENT DOCUMENTS

2011/0311293 A1* 12/2011 Yasuzaki ..... B41J 11/663 400/583
2013/0155131 A1* 6/2013 Izawa ..... B41J 11/46 347/5

FOREIGN PATENT DOCUMENTS

JP 2008-149657 A 7/2008

* cited by examiner

*Primary Examiner* — Jason Uhlenhake
(74) *Attorney, Agent, or Firm* — Canon USA, Inc. IP Division

(57) ABSTRACT

In a print system comprising a first printing unit for printing images on a first surface of a continuous sheet, a reading unit for reading an image, and a second printing unit for printing images on a second surface of the continuous sheet, in the case where the first printing unit prints a control image irregularly inserted between the images based on image data on the first surface of the continuous sheet, the first printing unit prints an identification mark which enables the control image to be identified on the first surface of the continuous sheet, and in the case where the reading unit reads an identification mark printed on the first surface of the continuous sheet, the second printing unit is caused not to print images based on image data in an area corresponding to the control image on the continuous sheet.

11 Claims, 9 Drawing Sheets

4900001150007

4900001150007

| IMAGE IDENTIFICATION | XX | XXX | XXXXX |
|---|---|---|---|
| NORMAL IMAGE | 00 | PAGE NUMBER OF FIRST SURFACE | NUMBER OF LINES OF 600DPI |
| INTER-IMAGE PRELIMINARY DISCHARGING PATTERN | 01 | | |
| NON-DISCHARGE MONITORING PATTERN | 02 | | |
| DEFECTIVE AREA | 03 | | |
| PRINT END | 04 | | |

CONTROL APPARATUS, CONTROL METHOD, AND PROGRAM

BACKGROUND

1. Technical Field

The present disclosure relates to a control apparatus, a control method, and a program.

2. Description of the Related Art

When printing is performed on continuous paper like roll paper, a method to use a plurality of printing apparatuses is known. In Japanese Patent Application Laid-Open No. 2008-149657, a first printing apparatus prints a plurality of control marks to be used for controlling print processing by a second printing apparatus for each image based on image data. Then, the second printing apparatus controls the print processing by reading the plurality of control marks. More specifically, a top of form (TOF) mark for adjusting a difference between print start positions on a front surface and on a back surface and a mark for adjusting a mismatch between print data printed on the front surface and print data printed on the back surface are described as the control marks. In addition, a color registration mark for adjusting color shift of print data printed on the front surface and the back surface and a post-processing mark indicating a position to be cut in a post-processing apparatus are described as other control marks.

However, the method described in Japanese Patent Application Laid-Open No. 2008-149657 performs print processing by setting a print output position of each mark based on sheet information. Therefore, for example, in the case of ink-jet method, printing cannot be performed if an irregular image pattern, such as a preliminary discharging pattern and a non-discharge monitoring pattern, is inserted.

SUMMARY

One aspect of the present invention is directed to provision of a control apparatus and a control method which can solve the above-described issue. Further, another aspect of the present invention is directed to provision of a control apparatus, a control method, and a program which can adjust positions of a first surface and a second surface if a pattern image is irregularly inserted.

According to an aspect of the present invention, a control apparatus included in a print system comprising a first printing unit configured to print a plurality of images based on image data on a first surface of a continuous sheet, a reading unit, and a second printing unit configured to print a plurality of images based on image data on a second surface of the continuous sheet, the control apparatus includes a first control unit configured to, in the case where the first printing unit prints a control image irregularly inserted between the images based on the image data on the first surface of the continuous sheet, cause the first printing unit to print an identification mark which enables the control image to be identified on the first surface of the continuous sheet, and a second control unit configured to, in the case where the reading unit reads the identification mark printed on the first surface of the continuous sheet, control the second printing unit not to print the image based on the image data in an area corresponding to the control image printed on the first surface of the continuous sheet when the second printing unit performs printing on the second surface of the continuous sheet.

Further features of the present invention will become apparent from the following description of exemplary embodiments with reference to the attached drawings.

DESCRIPTION OF THE EMBODIMENTS

Various exemplary embodiments, features, and aspects of the present invention will be described in detail below with reference to the drawings. Relative arrangements of respective components in an apparatus and shapes of the apparatus described in the exemplary embodiments are merely an example thereof. The exemplary embodiments which will be described below do not restrict to the invention according to the claims.

Figure 1:
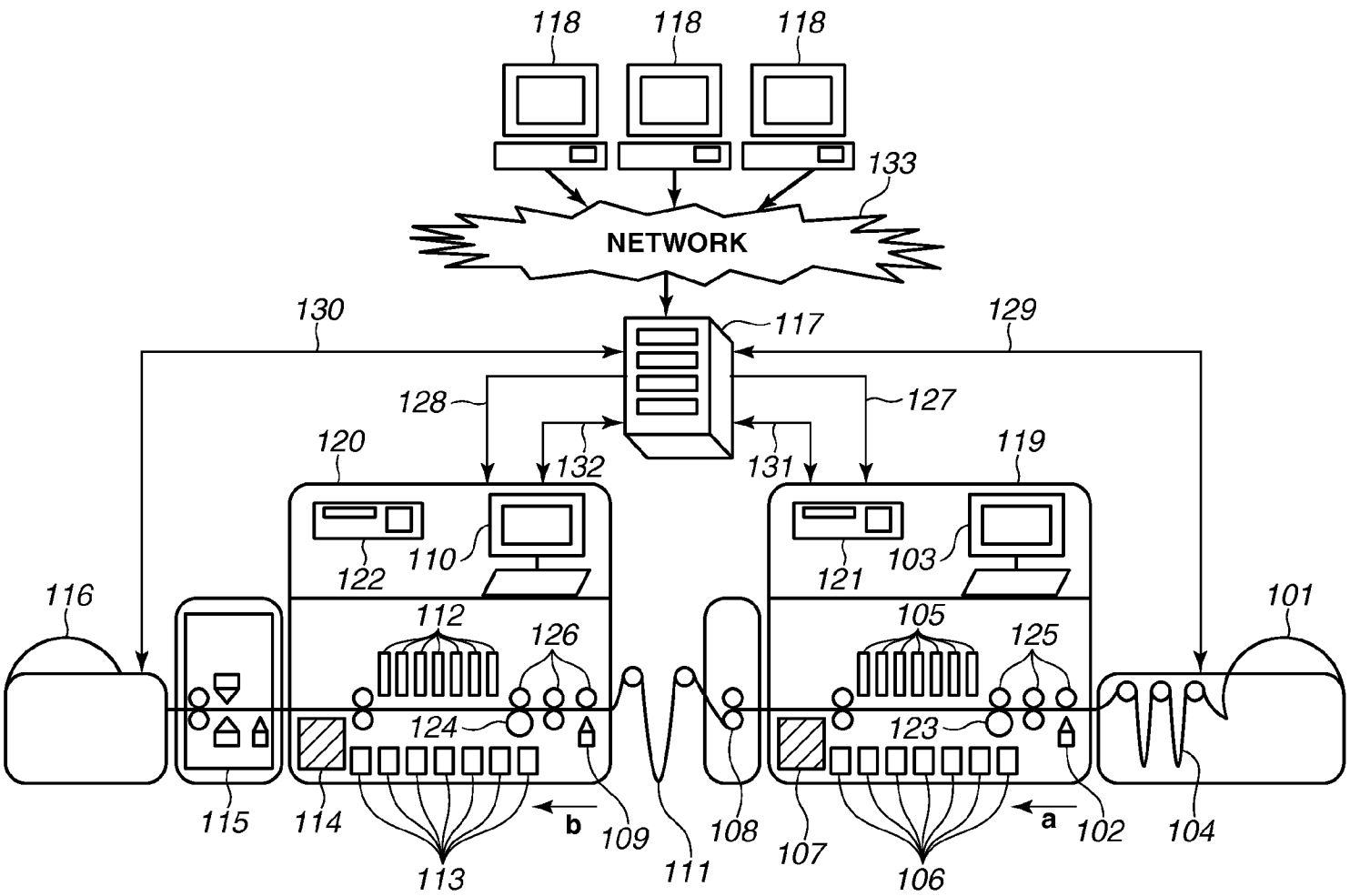
FIG. 1 illustrates a configuration of a print system according to an exemplary embodiment.

FIG. 1 illustrates a general configuration of a print system as an example of an exemplary embodiment of the present invention. The print system according to the present exemplary embodiment includes a first printing apparatus 119, a second printing apparatus 120, a sheet feeding unit 101, a reversing unit 108, a winding unit 116, a controller 117, and host computers 118. The print system uses a roll sheet (a continuous sheet which is continuous and longer than a print unit (one page) in a conveyance direction) as a printing medium.

According to the present exemplary embodiment, the first printing apparatus 119 and the second printing apparatus 120 each have only a print function, however, the present exemplary embodiment is not limited to this configuration. For example, the printing apparatus may function as a copying machine further provided with a reading apparatus for reading an image on a document and may be a multifunction peripheral having other functions. Further, according to the present exemplary embodiment, a roll sheet is described as an example of a printing medium (it is also referred to as a recording sheet) on which print processing is performed. However, a printing medium is not limited to a roll shape sheet, and any long continuous sheet can be used as long as printing of a plurality of pages can be continuously performed on one surface thereof without cutting. Regarding cutting of the continuous sheet, cutting may be automatically performed by the printing apparatus, performed in response to a user instruction manually issued, or performed in a post-process. A material of a recording medium is not limited to paper, and various materials can be used as long as it can be used in print processing. In addition, the printing apparatus may be the one which can print not only on a continuous sheet but also on a cut sheet which is preliminarily cut in a predetermined size. Further, a printing method for printing an image is not limited to an ink-jet method described below which uses liquid ink for image printing. A solid ink may be used as a recording agent, and various printing methods, such as an electrophotographic method using toner and a sublimation method can be employed. Furthermore, the printing apparatus is not limited to the one which performs color recording using recording agents in a plurality of colors and can perform monochrome recording in black (including gray) only. Printing is not limited to printing of a visible image, and an invisible image and an image which is hardly visible can be printed. Further, various types of printing other than general images, for example, a wiring pattern, a physical pattern used in manufacturing of components, and a DNA base sequence may be included. In other words, the present exemplary embodiment can be applied to various types of recording apparatus as long as it can apply a recording agent to a recording medium. The first printing apparatus 119 is located on upstream in a conveyance direction of a continuous sheet, and the second printing apparatus 120 is located on downstream in the conveyance direction thereof. The sheet feeding unit 101 supplies a roll sheet, i.e. a continuous sheet, to the first printing apparatus 119. The winding unit 116 winds up a sheet on which printing is completed from the second printing apparatus 120. The reversing unit 108 reverses front and back of a sheet output from the first printing apparatus 119. A scanner unit 115 optically reads an image of which printing is completed in the second printing apparatus 120 and confirms contents of the printed image. The controller 117 performs control of the first printing apparatus 119 and the second printing apparatus 120, and performs raster image processor (RIP) processing on print data. Print data includes, for example, image data of a print target.

To a network 133, the controller 117 and the host computers 118 for transmitting job data to the controller 117 are connected. The network 133 can be a wired or wireless one.

The host computer 118 transmits print job data to the controller 117 via the network 133. The host computer 118 creates print job data by selecting an image to be printed and performing settings of a print size, a layout, and the like. In FIG. 1, the host computers 118 are connected to the network 133. However, the configuration is not limited to this, and the host computers 118 may be directly connected to the controller 117. In addition, it is described above that the controller 117 receives print job data from the host computers 118. However, the configuration is not limited to this, and the controller 117 may receive print job from a portable media, such as a universal serial bus (USB) memory. The host computer 118 obtains a progress state of the transmitted print job from the controller 117, the first printing apparatus 119, and the second printing apparatus 120, and manage the progress states.

The controller 117 receives job data from the host computer 118 and performs RIP processing on the job data for converting the job data into a raster image format which is supported by each of the printing apparatuses. Then, the controller 117 transmits print data to the first printing apparatus 119 and the second printing apparatus 120 via data communication interfaces (IF) 127 and 128. The data communication IFs 127 and 128 are configured with an interface, such as an optical fiber, which can transmit and receive data at high speed, and a large amount of print data can be transmitted from the controller 117 to the first printing apparatus 119 and the second printing apparatus 120. According to the present exemplary embodiment, one single controller 117 receives print jobs from the host computers 118 and performs RIP processing. However, a different computer may receive print jobs, and a further different computer may perform RIP processing. Further, as in a server configuration, processing may be separated so that reception of a print job and RIP processing are performed by each internal blade. RIP processing may be performed each of the printing apparatuses, but according to the present exemplary embodiment, it is described that each of the printing apparatuses receives RIP processed print data. As described above, the configuration of the host computers 118, the network 133, and the controller 117 is not limited to the one illustrated in FIG. 1.

The controller 117 transmits a control command via control communication IFs 129, 130, 131, and 132 to the first printing apparatus 119, the second printing apparatus 120, the sheet feeding unit 101, and the winding unit 116 to control the respective apparatuses and units. The controller 117 also transmits information of a print job and various types of setting data pieces necessary for printing and control to the first printing apparatus 119 and the second printing apparatus 120 via the control communication IFs 131 and 132. Further, the controller 117 obtains a state of each of the printing apparatuses and information about progress, such as a print job is in progress or completed, from the first printing apparatus 119 and the second printing apparatus 120.

The first printing apparatus 119 receives RIP processed print data from the controller 117 via the data communication IF 127. The first printing apparatus 119 includes a reading sensor 102 for reading various marks printed on a sheet, a recording head 105 corresponding to each color, and an ink tank 106 corresponding to the each color for supplying the ink to the recording head 105. The first printing apparatus 119 further includes a dryer unit 107 for drying ink of an image printed on a sheet and an operation unit 103. The operation unit 103 is used by a user to perform various instructions and operations and notifies a user of various types of information. For example, a user can confirm a printing state of an individual order such as printing of an image is in progress or completed. Further, a user can confirm various apparatus states like an ink remaining amount and a sheet remaining amount, input a position adjustment value and a registration adjustment value of a recording head, and issue an instruction to execute maintenance of the apparatus such as a recording head recovery operation. The first printing apparatus 119 includes a control unit 121, an encoder 123 for controlling a conveyance amount and a conveyance state of a recording material, and conveyance rollers 125. The control unit 121 includes a controller (a central processing unit (CPU) or a micro processing unit (MPU)), an output device for user interface information (i.e., a generator of display information, acoustic information, and the like), and a control portion provided with various input/output (I/O) interfaces, and comprehensively controls the entire first printing apparatus 119. The configuration of the first printing apparatus 119 is not limited to the above-described one, and for example, units and sensors can be added thereto if needed.

The second printing apparatus 120 receives print data from the controller 117 via the data communication IF 128. The second printing apparatus 120 includes a reading sensor 109 for reading various marks printed on a sheet, a recording head 112 corresponding to each color, and an ink tank 113 corresponding to the each color for supplying the ink to the recording head 112. The second printing apparatus 120 further includes a dryer unit 114 for drying ink of an image printed on a sheet and an operation unit 110. The operation unit 110 is used by a user to perform various instructions and operations and notifies a user of various types of information. For example, a user can confirm a printing state of an individual order such as printing of an image is in progress or completed. Further, a user can confirm various apparatus states like an ink remaining amount and a sheet remaining amount, input a position adjustment value and a registration adjustment value of a recording head, and issue an instruction to execute maintenance of the apparatus such as a recording head recovery operation. The second printing apparatus 120 includes a control unit 122, an encoder 124 for controlling a conveyance amount and a conveyance state of a recording material, and conveyance rollers 126. The control unit 122 includes a controller (a CPU or a MPU), an output device for user interface information (i.e., a generator of display information, acoustic information, and the like), and a control portion provided with various I/O interfaces, and comprehensively controls the entire second printing apparatus 120. The configuration of the second printing apparatus 120 is not limited to the above-described one, and for example, units and sensors can be added thereto if needed.

According to the present exemplary embodiment, the first printing apparatus 119 and the second printing apparatus 120 have the same configuration. However, they can have different configurations from each other, such as only the first printing apparatus 119 includes a control circuit board for controlling the sheet feeding unit 101. The configuration is not limited to the above-described one.

The sheet feeding unit 101 controls conveyance of a sheet to the first printing apparatus 119. A user loads sheets to a control bar in the sheet feeding unit and then loads the sheets into the main body of the sheet feeding unit. The sheet feeding unit 101 starts conveyance of a sheet when receiving an instruction to start feeding the sheet from the controller 117 via the control communication IF 129. The sheet feeding unit 101 includes a loop creation control unit 104 for absorbing an error in a conveyance speed to adjust the conveyance speed. The sheet feeding unit 101 is provided with the loop control unit, however, the configuration is not limited to this. For example, the first printing apparatus 119 may be provided with the loop control unit for absorbing the conveyance speed. A sheet drawn out from the sheet feeding unit 101 is conveyed in a direction "a" in FIG. 1 and reaches the first printing apparatus 119. According to the present exemplary embodiment, a sheet configuration is described using the sheet feeding unit. However, as described above, feeding of cut sheets and feeding of a continuous sheet which is not in a roll shape can be applied to the present exemplary embodiment. The first printing apparatus 119 performs printing of an image according to print data received from the controller 117. The recording head 105 includes separated recording heads corresponding to the numbers of a plurality of colors disposed along the sheet conveyance direction. According to the present exemplary embodiment, the recording head 105 is a line type recording head corresponding to seven colors, namely cyan (C), magenta (M), yellow (Y), light cyan (LC), light magenta (LM), gray (G), and black (K). The recording head 105 may correspond to colors other than the above, and does not have to correspond to all of these colors. The first printing apparatus 119 discharges ink from the recording head 105 by synchronizing conveyance of a sheet (a recording material) to form an image on the sheet. The recording head 105 is located in a position at which an ink discharge destination does not overlap with the conveyance roller 125. According to the present exemplary embodiment, ink is directly discharged to a sheet. However, a configuration which applies ink to an intermediate transfer member and then applies to a sheet to form an image can be used instead of the above-described one.

The ink tank 106 separately stores each color ink. The ink tank 106 supplies the respective inks to sub tanks (not illustrated) corresponding to the respective colors via tubes, and the inks are supplied from the sub tanks to each of the recording heads 105 via tubes. The recording head 105 includes line heads of the respective colors (seven colors in the present exemplary embodiment) disposed along the "a" direction, namely the conveyance direction at the time of printing. The line heads of the respective colors may be formed by a single nozzle tip without joint or formed by divided nozzle tips which are regularly disposed in a row or in a staggered arrangement. According to the present exemplary embodiment, a full multi-head is used in which nozzles are disposed in an area covering a width of a print area of a maximum side sheet that the apparatus can handle. An ink-jet method which discharges an ink from a nozzle can employ, a method using a heating element, a method using a piezoelectric element, a method using an electrostatic element, a method using a microelectromechanical system (MEMS) element, and so on. Ink is discharged from nozzles of each recording head based on print data, and a discharge timing is determined by an output signal from the encoder 123 for conveyance. According to the present exemplary embodiment, an ink-jet type printer using ink as a recording agent is described as an example, however, the printer is not limited to the above-described one. Various types of printers including an electrophotographic method printer, such as a thermal printer (a sublimation type, a thermal transfer type, and the like), a dot-impact printer, a light-emitting diode (LED) printer, and a laser printer, can be used.

After an image is formed on the sheet, the sheet is conveyed to the dryer unit 107. The dryer unit 107 heats the sheet passing through the unit by warm air (heated gas, i.e. air) for drying the sheet on which ink is applied in a short time. Various drying methods, such as drying by cool air, heating by a heater, natural drying by just waiting, and drying by irradiating with an electromagnetic wave like ultraviolet light can be used instead of drying by warm air.

When drying of the image printed on the sheet is finished, the sheet is conveyed to the reversing unit 108. The reversing unit 108 reverses front and back of the sheet to perform printing on a back surface of a first surface on which an image is printed by the first printing apparatus 119. The reversed sheet passes through a loop creation control unit 111 for absorbing an error in the conveyance speed and reaches the second printing apparatus 120. The loop control unit is provided after the reversing unit 108, however, the second printing apparatus 120 may be provided with the loop control unit for absorbing the conveyance speed.

The reversing unit 108 is removably installed. When one-side printing is performed as described below, the first printing apparatus 119 and the second printing apparatus 120 both can be configured to perform printing on a first surface by removing the reversing unit 108.

The second printing apparatus 120 prints an image according to print data received from the controller 117. The second printing apparatus 120 first reads, by the reading sensor 109, marks printed on the first surface for detecting a position and for identifying what kind of image is printed on the first surface and determines an image to be printed on a second surface corresponding to the first surface and a position to start printing of an image on the second surface. The second printing apparatus 120 determines an image to be printed on the second surface and a print timing thereof according to a result read by the reading sensor 109. The recording head 112, the ink tank 113, and the dryer unit 114 respectively have configurations similar to the recording head 105, the ink tank 106, and the dryer unit 107 in the first printing apparatus 119, thus descriptions thereof are omitted. Similarly, an encoder 124 for conveyance and a conveyance roller 126 respectively have configurations similar to the encoder 123 for conveyance and the conveyance roller 125 in the first printing apparatus 119, thus descriptions thereof are omitted.

After completion of drying of the printed image, the sheet is conveyed to the scanner unit 115. In the scanner unit 115, two scanner sensors are disposed to face to each other so as to read both surfaces of a sheet at the same time, so that the scanner unit 115 can read and confirm images printed on the both surfaces of the sheet concurrently. The scanner unit 115 optically reads a printed image and a special pattern on a sheet to confirm whether the printed image includes any defect and states of the apparatuses including an ink discharge state. According to the present exemplary embodiment, as a method for confirming an image, an ink discharge state can be confirmed by reading a pattern for checking a state of the head, and success or failure of printing can be confirmed by comparing with an original image. The confirming method can be appropriately selected from various methods. In addition, if a state of an image and a state of the apparatus is determined as no good (NG) by the confirmation, a hole by a puncher or a mark is put on the image so as to be able to understand which image state is NG. According to the present exemplary embodiment, the scanner unit 115 disposed on the downstream of the second printing apparatus 120 is provided with two scanner sensors to concurrently read both surfaces of a sheet, however, the configuration of the scanner unit 115 is not limited to the above-described one. For example, a first scanner sensor may be disposed directly behind the first printing apparatus 119 to scan and confirm a printed image on the first surface, and a second scanner sensor may be disposed behind the second printing apparatus 120 to scan (read) and confirm a printed image on the second surface. In addition, reading is performed by the scanner unit according to the present exemplary embodiment, however, reading may be performed by a device using an area sensor like a camera. When scanning is completed, the sheet is conveyed to the winding unit 116.

The winding unit 116 performs control to wind the sheet which is discharged from the second printing apparatus 120 and on which printing is completed. The winding unit 116 starts a winding operation in response to a winding instruction output from the controller 117 via the control communication IF 130 and winds up the sheet on which printing is performed on the both surfaces. The print system according to the present exemplary embodiment can perform both of one-side printing and double-side printing. In the case of the one-side printing, printing may be performed by the first printing apparatus 119 or the second printing apparatus 120, or the first printing apparatus 119 and the second printing apparatus 120 may share a job with each other by job, by page, or by image in one page. In the case of the double-side printing, the first printing apparatus 119 may perform printing on a first surface and the second printing apparatus 120 performs printing on a second surface, or, the first printing apparatus 119 may perform printing on a second surface and the second printing apparatus 120 may perform printing on a first surface.

According to the present exemplary embodiment, the print system configured with two printing apparatuses is described, however, the print system is not limited to the above-described one. The print system may include three or more printing apparatuses which are overlappingly connected to one another, or a plurality sets of two overlappingly connected printing apparatuses and control them by one controller 117.

Figure 2:
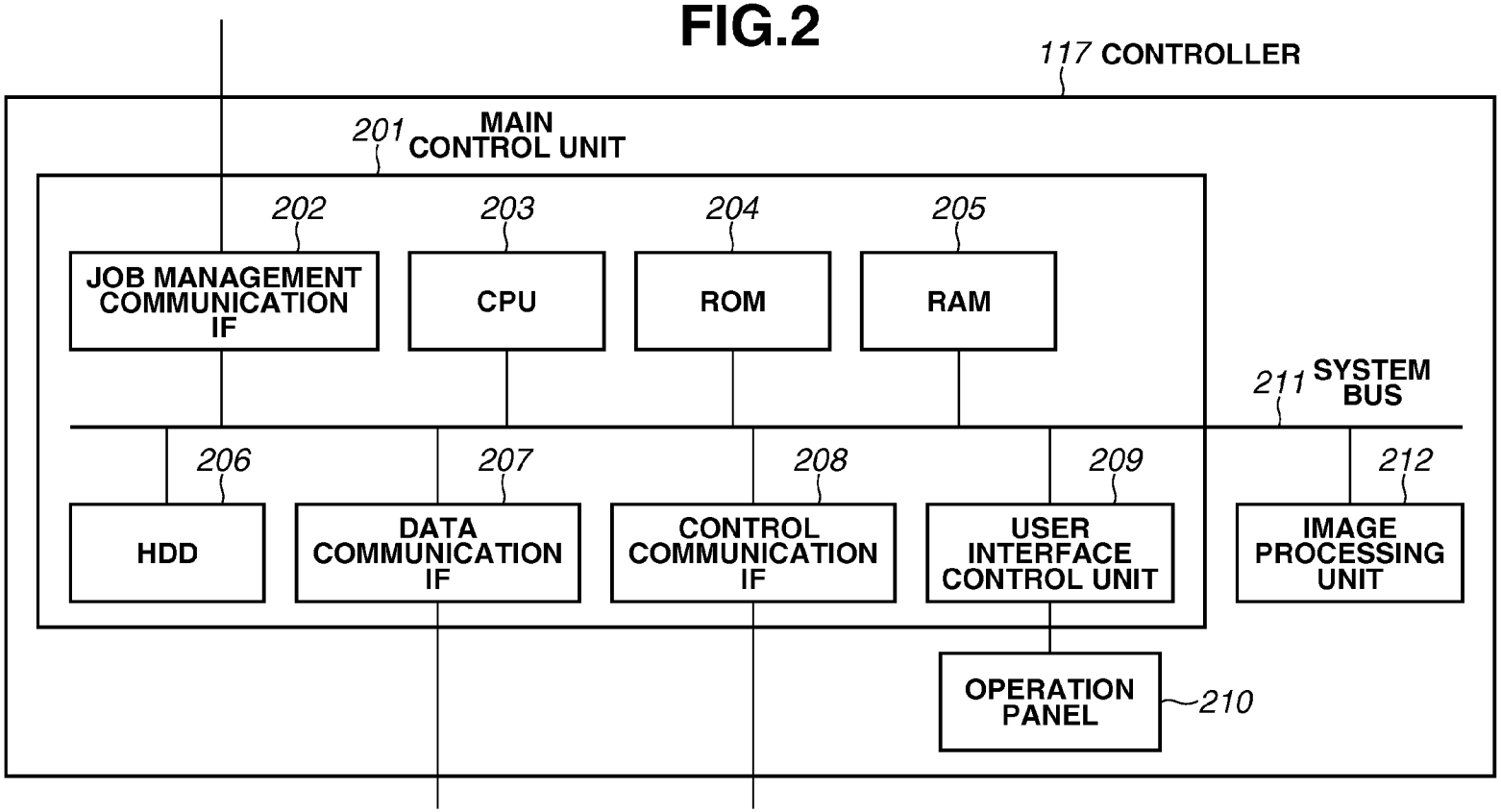
FIG. 2 is a block diagram illustrating a configuration of a controller in the print system according to the exemplary embodiment.

FIG. 2 is a block diagram illustrating a control configuration of the controller 117 applied in the present exemplary embodiment. In FIG. 2, the controller 117 includes a main control unit 201 and an image processing unit 212. These units are connected to one another by a system bus 211.

The main control unit 201 is a main control unit of the controller 117. The main control unit 201 converts job data supplied from the host computer 118 to print data (raster image data) in the image processing unit 212. Further, the main control unit 201 controls printing in the first printing apparatus 119 and the second printing apparatus 120 connected via the control communication IF 208 and the data communication IF 207. The main control unit 201 includes a job management communication IF 202, a central processing unit (CPU) 203, a read-only memory (ROM) 204, a random access memory (RAM) 205, a hard disk drive (HDD) 206, a data communication IF 207, a control communication IF 208, and a user interface control unit 209. These units and interfaces are connected to one another by the system bus 211.

The image processing unit 212 includes a CPU, a ROM, and a RAM as with the main control unit 201.

The job management communication IF 202 transmits and receives a print job and other commands supplied from the host computer 118, a status signal, and so on. The CPU 203 performs various calculations and comprehensively controls the entire controller 117. The ROM 204 stores various control programs executed by the CPU 203 and fixed data pieces. The RAM 205 is used as a working area for various calculations and control performed by the CPU 203. The HDD 206 is an area for temporarily storing a print job and a required table supplied from the host computer 118, print data obtained from the image processing unit 212, and so on. The data communication IF 207 is an interface for transmitting print data stored in the HDD 206 to the first printing apparatus 119 and the second printing apparatus 120. The control communication IF 208 is an interface for transmitting and receiving a control command, a status signal, and the like between the first printing apparatus 119 and the second printing apparatus 120. The user interface control unit 209 is an interface for transmitting and receiving a command and the like between an operation panel 210.

The operation panel 210 is an input device for a user to perform print settings and the like by operating the first printing apparatus 119 and the second printing apparatus 120. The operation panel 210 further has a role as a display apparatus for notifying a user of statuses of the first printing apparatus 119 and the second printing apparatus 120 and the like. The operation panel 210 is connected to the system bus 211 via the user interface control unit 209 in the main control unit 201.

The image processing unit 212 converts a color space (for example, YCbCr) of a print job to a standard red-green-blue (RGB) color space (for example, sRGB) according to a control command received from the main control unit 201. In addition, various types of image processing, such as resolution conversion for effective pixel numbers, image analysis, and image correction, are executed as necessary. Print data obtained by the above-described image processing is stored in the HDD 206.

Figure 3:
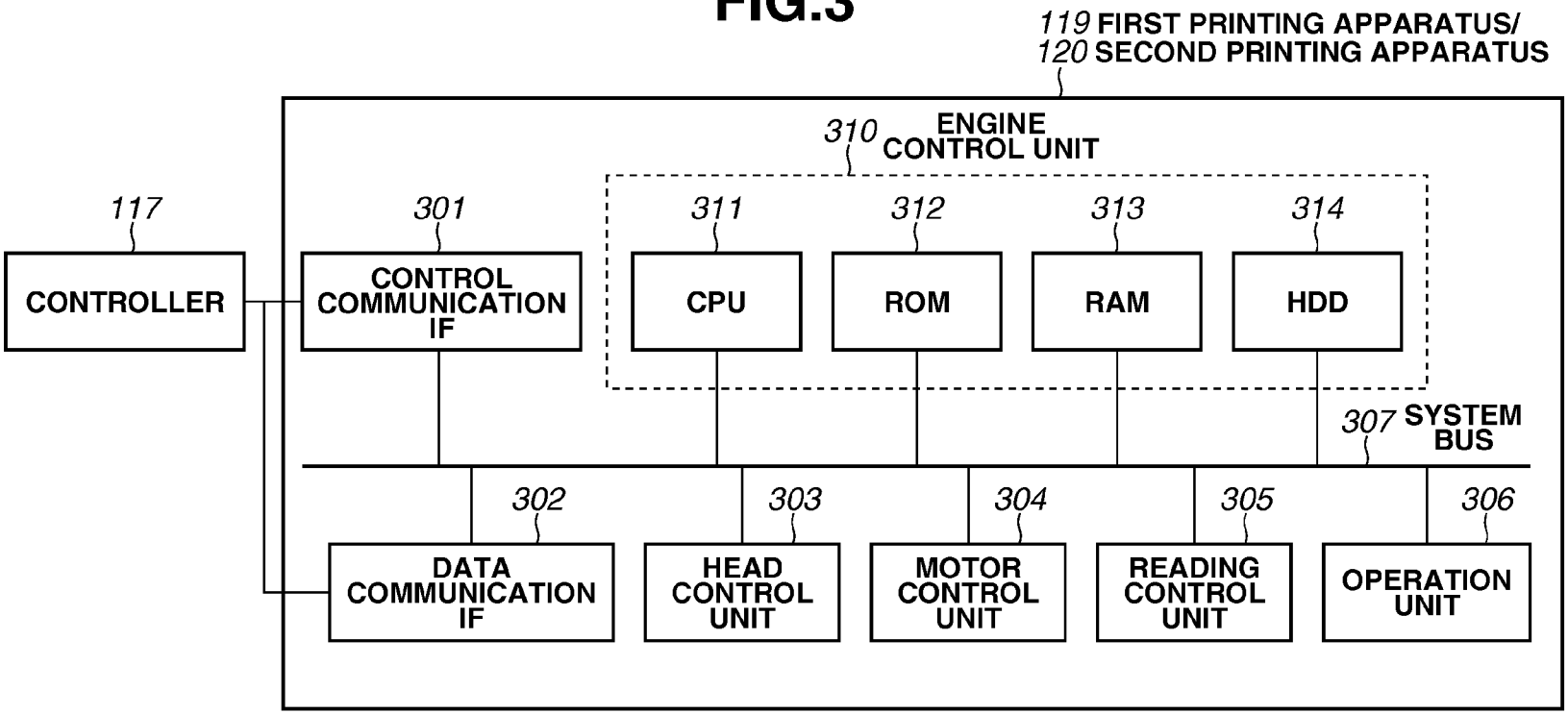
FIG. 3 is a block diagram illustrating a configuration of an engine in the print system according to the exemplary embodiment.

FIG. 3 is a block diagram illustrating a control configuration of the first printing apparatus 119 and the second printing apparatus 120. According to the present exemplary embodiment, the first printing apparatus 119 and the second printing apparatus 120 are described that they have the same configuration. However, they may have different configurations.

The first printing apparatus 119 and the second printing apparatus 120 each include a control communication IF 301, a data communication IF 302, an engine control unit 310, a head control unit 303, a motor control unit 304, a reading control unit 305, and an operation unit 306. These components are connected to one another by a system bus 307. The engine control unit 310, the head control unit 303, the motor control unit 304, and the reading control unit 305 illustrated in FIG. 3 are included in each of the control units 121 and 122. Further, the operation unit 306 is included each of the operation units 103 and 110. The control communication IF 301 and the data communication IF 302 are interfaces for connecting the first printing apparatus 119 and the second printing apparatus 120 to the controller 117. The control communication IF 301 is an interface for receiving a control command, a status signal, and the like from the controller 117. The data communication IF 302 is an interface for receiving print data from the controller 117.

The engine control unit 310 includes a CPU 311, a ROM 312, a RAM 313, and a HDD 314, and these components are connected to one another by the system bus 307.

The CPU 311 performs various calculations to control the entire first printing apparatus 119 or the entire second printing apparatus 120. The ROM 312 stores various control programs executed by the CPU 311 and fixed data pieces necessary for various operations of the printing apparatus. The RAM 313 is used as a working area of the CPU 311 and a temporary storage area of various received data pieces, and stores various setting data pieces. The HDD 314 stores a parameter, a table, and the like required for various operations of the printing apparatus.

The engine control unit 310 controls the head control unit 303, the motor control unit 304, and the reading control unit 305 according to a control command received from the controller 117 via the control communication IF 301 and records print data in the recording medium. The head control unit 303 controls driving of the recording heads 105 and 112 according to a control command received from the engine control unit 310 via the system bus 307 and print data received from the controller 117 via the data communication IF. Accordingly, the print data is recorded on a recording medium.

The motor control unit 304 drives a stepping motor or the like according to a control command received from the engine control unit 310 via the system bus 307 and performs control of a conveyance mechanism, such as driving control of the conveyance rollers 125 and 126.

The reading control unit 305 detects a mark or the like printed on a recording medium using the reading sensors 102 and 109 according to a control command received from the engine control unit 310 via the system bus 307.

The operation unit 306 is an input output interface between a user and includes an input unit, such as hard keys and a touch panel, and an output unit, such as a display for indicating information and an audio generator. The operation unit 306 is used to set parameters necessary for various operations of the printing apparatus and displays a printing status and sheets to be used.

According to the present exemplary embodiment, it is described that the engine control unit 310 controls the head control unit 303, the motor control unit 304, and the reading control unit 305 according to a control command received from the controller 117, however, the configuration is not limited to the above-described one. For example, the control units may transmit and receive control commands among them, and the respective control units may receive a control command directly from the controller 117.

Further, according to the present exemplary embodiment, it is described that the head control unit 303 receives print data directly from the controller 117, however, the configuration is not limited to the above-described one. For example, the engine control unit 310 may receive print data from the controller 117, and the engine control unit 310 may transmit the print data to the head control unit 303 via the system bus 307.

Figure 4:
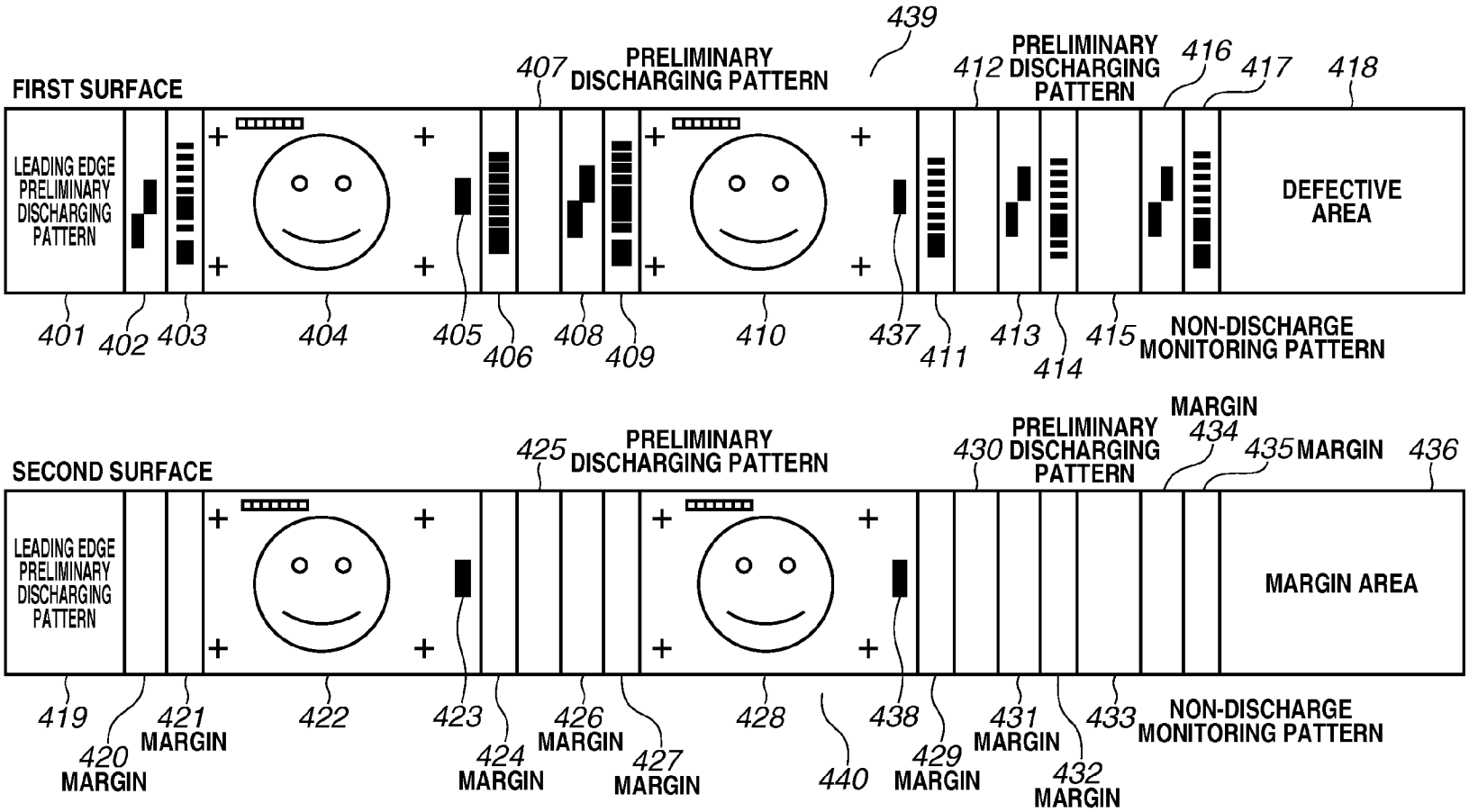
FIG. 4 illustrates an example of patterns to be printed on a first surface and a second surface of a continuous sheet.

FIG. 4 is an example of image patterns to be printed on a first surface and a second surface of a sheet. An image print pattern group 439 is an example of a print pattern when the first printing apparatus 119 prints normal images and control patterns on a first surface. In this description, a normal image is an image to be provided to a user based on image data (namely job data according to the present exemplary embodiment), and a control pattern is a pattern image other than an image based on the image data to be used for control by the printing apparatus. A control pattern is irregularly inserted, for example, it is inserted when the number of lines in an image and/or dot counts become equal to or greater than a predetermined threshold value. In other words, a control pattern is not always inserted regularly with respect to an image (for example, number of images), but for example, when image sizes and image density are different, a control pattern is inserted irregularly with respect to the image. In addition, when image sizes are constant, a control pattern is sometimes inserted regularly with respect to the image.

According to the present exemplary embodiment, an identification mark, a cutter mark, a leading edge preliminary discharging pattern, a preliminary discharging pattern, and a non-discharge monitoring pattern are described as examples of a control pattern, however, the control pattern is not limited to these marks and patterns. A leading edge preliminary discharging pattern, a preliminary discharging pattern, and a non-discharge monitoring pattern are patterns to be used for control of the first printing apparatus or the second printing apparatus, and they are irregularly inserted into normal images. In the description below, a leading edge preliminary discharging pattern, a preliminary discharging pattern, and a non-discharge monitoring pattern are also referred to as a "control image".

A normal image is formed in such a manner that the controller 117 performs RIP processing on data, and the first printing apparatus 119 or the second printing apparatus 120 which received the RIP processed data prints the data.

Preliminary discharge is performed so as to normally discharge ink and executed using a preliminary discharging pattern before discharging ink for printing an image based on image data. Further, a preliminary discharging pattern is a pattern formed for performing preliminary discharge and is stored in the ROM 312. Leading edge preliminary discharge is preliminary discharge for printing on a leading edge of a sheet. A leading edge preliminary discharging pattern is a pattern previously stored in the HDD 314 and is used for printing on a leading edge of a sheet. Preliminary discharge between images is performed randomly or at a certain regular interval (for example, every certain conveyance distance and every certain ink used amount), thus a quality of image can be maintained. A preliminary discharging pattern may be stored in the HDD 314.

A non-discharge monitoring pattern, which is one of the control patterns, is a check pattern for checking whether any nozzle in the recording heads causes non-discharge. A non-discharge monitoring pattern is previously stored in the HDD 314 as a dedicated pattern prepared for each single color of the recording head, and the first printing apparatus 119 or the second printing apparatus 120 performs pattern printing when receiving an instruction to print a non-discharge monitoring pattern. A non-discharge monitoring pattern may be stored in the ROM 312.

A cutter mark is a mart printed for specifying a position to be cut in a post-process and is previously stored in the HDD 314. According to the present exemplary embodiment, there are two cutter marks, one is inserted between images and the other is included in image data and printed concurrently with a normal image. A shape of a mark can be any pattern, such as a circular shape and a triangular shape, as long as the shape can be read in the post-process.

An identification mark is a mark for enabling identification of an image and is printed before or after an image to be identified. According to the present exemplary embodiment, an identification mark is printed right before an image to be identified. An identification mark is, for example, a bar code or an alternative thereto. An identification mark is previously stored in the HDD 314 and generated by changing information to be embedded therein according to an image to be identified. For example, when a normal image is identified, an identification mark for identifying a normal image is inserted right before the normal image and printed. Further, when a control image is identified, an identification mark for identifying a control image is inserted right before the control image and printed. According to the present exemplary embodiment, a mark for identifying a normal image and a mark for identifying a control image have the same form (for example, a bar code and the like), and only information embedded thereto is changed. A form of an identification mark is not limited to a bar code, and any form can be used as long as a plurality of information pieces can be embedded in a mark (i.e., a mark which can store a plurality of information pieces).

According to the present exemplary embodiment, the image print pattern group 439 is printed on a first surface of a continuous sheet as illustrated in FIG. 4. More specifically, printing is first performed on a first surface of a continuous sheet in the order of a leading edge preliminary discharging pattern 401, a cutter mark 402, an identification mark 403, a normal image 404, a cutter mark 405, an identification mark 406, a preliminary discharging pattern 407, and a cutter mark 408.

The identification mark 403 is printed right before the normal image 404, so that an image printed after the identification mark 403 can be identified as a normal image. A normal image is an image based on the RIP processed data received by the first printing apparatus 119. The identification mark 406 is different from the identification mark 403, and is a mark enabling identification of a preliminary discharging pattern between images (which is also referred to as inter-image preliminary discharging), which is one of the control image. The identification mark 406 is printed right before the preliminary discharging pattern. Even if a type of the identification mark 406 is the same as that of the identification mark 403, embedded information is different. The cutter mark 408 is a cutter mark for cutting a control image, such as the preliminary discharging pattern 407, in the post-process. The cutter mark 408 may be the same mark as the cutter mark 405 or a different mark for separating a control image in the post-process, as long as it can be cut in the post-process.

Further, on the first surface of the sheet, an identification mark 409, a normal image 410, a cutter mark 437, an identification mark 411, a preliminary discharging pattern 412, a cutter mark 413, an identification mark 414, a non-discharge monitoring pattern 415, a cutter mark 416, and an identification mark 417 are printed in this order.

The identification mark 409 is a mark for identifying a normal image as with the identification mark 403. The identification mark 409 may be exactly the same as the identification mark 403. However, according to the present exemplary embodiment, the identification mark 409 is not exactly the same as the identification mark 403 and information embedded therein is different. The cutter mark 437 is a cutter mark for cutting the normal image 410 in the post-process. The identification mark 411 is a mark for identifying the preliminary discharging pattern 412 between images which is printed right after the identification mark 411. The cutter mark 413 is a cutter mark for cutting the preliminary discharging pattern 412 in the post-process. The identification mark 414 is a mark for identifying the non-discharge monitoring pattern 415. The non-discharge monitoring pattern 415 is a check pattern for checking whether the recording head 105 causes non-discharge. The cutter mark 416 is a cutter mark for cutting the non-discharge monitoring pattern 415 in the post-process.

When control images are successively disposed as in the case of the preliminary discharging pattern 412 and the non-discharge monitoring pattern 415 illustrated in FIG. 4, only the cutter mark 416 may be printed by omitting the cutter mark 413. In other words, control can be performed without inserting the cutter mark 413.

The identification mark 417 is a mark for identifying a defective area 418. The identification mark 417 may be the same as or different from the other identification marks 406, 411, and 414, and when a defective area is detected, the identification mark 417 is printed right before the defective area. The defective area 418 is a defective area in the continuous sheet on which printing cannot be performed. Next, printing on the second surface of the continuous sheet is described. Printing on the second surface of the continuous sheet corresponds to the image print pattern group 439. According to the present exemplary embodiment, an image print pattern group 440 as illustrated in FIG. 4 is printed on the second surface of the continuous sheet. More specifically, printing is performed on the second surface of the continuous sheet in the order of a leading edge preliminary discharging pattern 419, a normal image 422, a cutter mark 423, a preliminary discharging pattern 425, a normal image 428, and a cutter mark 438 as illustrated in FIG. 4. Further, a preliminary discharging pattern 430 and a non-discharge monitoring pattern 433 are printed in this order.

The leading edge preliminary discharging pattern 419 is printed on a position corresponding to the leading edge preliminary discharging pattern 401. In other words, the leading edge preliminary discharging pattern 419 is printed on the second surface at a position similar to that of the leading edge preliminary discharging pattern 401 on the first surface. Then, a margin 420 is inserted in a position corresponding to the cutter mark 402. In addition, a margin 421 is inserted into a position corresponding to the identification mark 403. Margins are inserted because it is sufficient that a cutter mark is printed on either one of the surfaces and the identification mark 403 is printed on the first surface. A margin in this description is a portion on which printing is not performed (ink is not applied).

When the reading sensor 109 reads the identification mark 403 and identifies that the normal image is in a next area on the first surface, the motor control unit 304 conveys the sheet for a number of specified steps from where the identification mark 403 is identified. Then, the normal image 422 is printed on a position corresponding to the normal image 404. The cutter mark 423 is a cutter mark accompanying the normal image 422 and to be cut in the post-process as with the cutter mark 405. Then, a margin 424 corresponding to the identification mark 406 is inserted into. When the reading sensor 109 reads the identification mark 406 and identifies that the preliminary discharging pattern between images is printed on a next area on the first surface, the preliminary discharging pattern 425 between images is printed on an opposite surface to correspond to the preliminary discharging pattern 407 between images.

In addition, a margin 426 is inserted into a position corresponding to the cutter mark 408, and a margin 427 is inserted into a position corresponding to the identification mark 409.

When the reading sensor 109 reads the identification mark 409 and identifies that the normal image is in a next area on the first surface, the motor control unit 304 conveys the sheet for a specified amount (a number of specified steps in the case of a stepping motor) from where the identification mark 409 is identified. Then, the normal image 428 is printed on a position corresponding to the normal image 410. In addition, a margin 429 is inserted into a position corresponding to the identification mark 411.

When the reading sensor 109 reads the identification mark 411 and identifies that the preliminary discharging pattern between images is in a next area on the first surface, the preliminary discharging pattern 430 between images is inserted. Then, a margin 431 is inserted into a position corresponding to the cutter mark 413, and a margin 432 is inserted into a position corresponding to the identification mark 414.

When the reading sensor 109 reads the identification mark 414 and identifies that the non-discharge monitoring pattern is in a next area on the first surface, the non-discharge monitoring pattern 433 is printed on an opposite surface to correspond to the non-discharge monitoring pattern 415. Then, a margin 434 is inserted into a position corresponding to the cutter mark 416, and a margin 435 is inserted into a position corresponding to the identification mark 417.

When the reading sensor 109 reads the identification mark 417 and identifies that a next area on the first surface is the defective area, a margin area 436 is inserted into a position corresponding to the defective area 418.

According to the present exemplary embodiment, margins are inserted on the second surface at positions where the cutter marks and the identification marks are printed on the first surface, however, the configuration is not limited to the above-described one. For example, processing for inserting a preliminary discharging pattern for maintaining the apparatus state and processing for printing a pattern for confirming an image can be performed.

According to the present exemplary embodiment, a preliminary discharging pattern and a non-discharge monitoring pattern are regularly inserted according to the number of print lines. For example, the control pattern is regularly inserted in such a manner that a preliminary discharging pattern is inserted when 15000 lines (in terms of 600 dpi) are printed, and a non-discharge monitoring pattern is inserted when 30000 lines (in terms of 600 dpi) are printed. When insertion of a preliminary discharging pattern is performed at the above-described setting, a next preliminary discharging pattern is inserted between normal images within a range not exceeding 15000 lines. Therefore, a preliminary discharging pattern is sometimes inserted into 14000-th line and sometimes inserted into 10000-th line from the previous pattern depending on a length of a normal image. Further, the same is true as for a non-discharge monitoring pattern, and a next non-discharge monitoring pattern is inserted between normal images within a range not exceeding 30000 lines, which is used as a base. Therefore, a non-discharge monitoring pattern is sometimes inserted into 20000-th line and sometimes inserted into 28000-th line from the previous pattern depending on a length of a normal image. As described above, the control pattern is set to be inserted at a regular frequency, but an insertion timing (number of lines) varies depending on a situation, such as a length of an image, thus the control pattern is irregularly inserted. In other words, a timing when the control pattern is inserted is irregular with respect to the number of normal images and cannot be simply predicted.

According to the present exemplary embodiment, the first printing apparatus performs printing on a first surface of a continuous sheet, and the second printing apparatus performs printing on a second surface of the continuous sheet, so that double-side printing is performed. Thus, the number of print lines of a normal image printed by the first printing apparatus is same as that of a normal image printed by the second printing apparatus. Therefore, the second printing apparatus has only to insert a preliminary discharging pattern and a non-discharge monitoring pattern at the same timing as the timing that the first printing apparatus inserted a preliminary discharging pattern and a non-discharge monitoring pattern.

Figure 5:
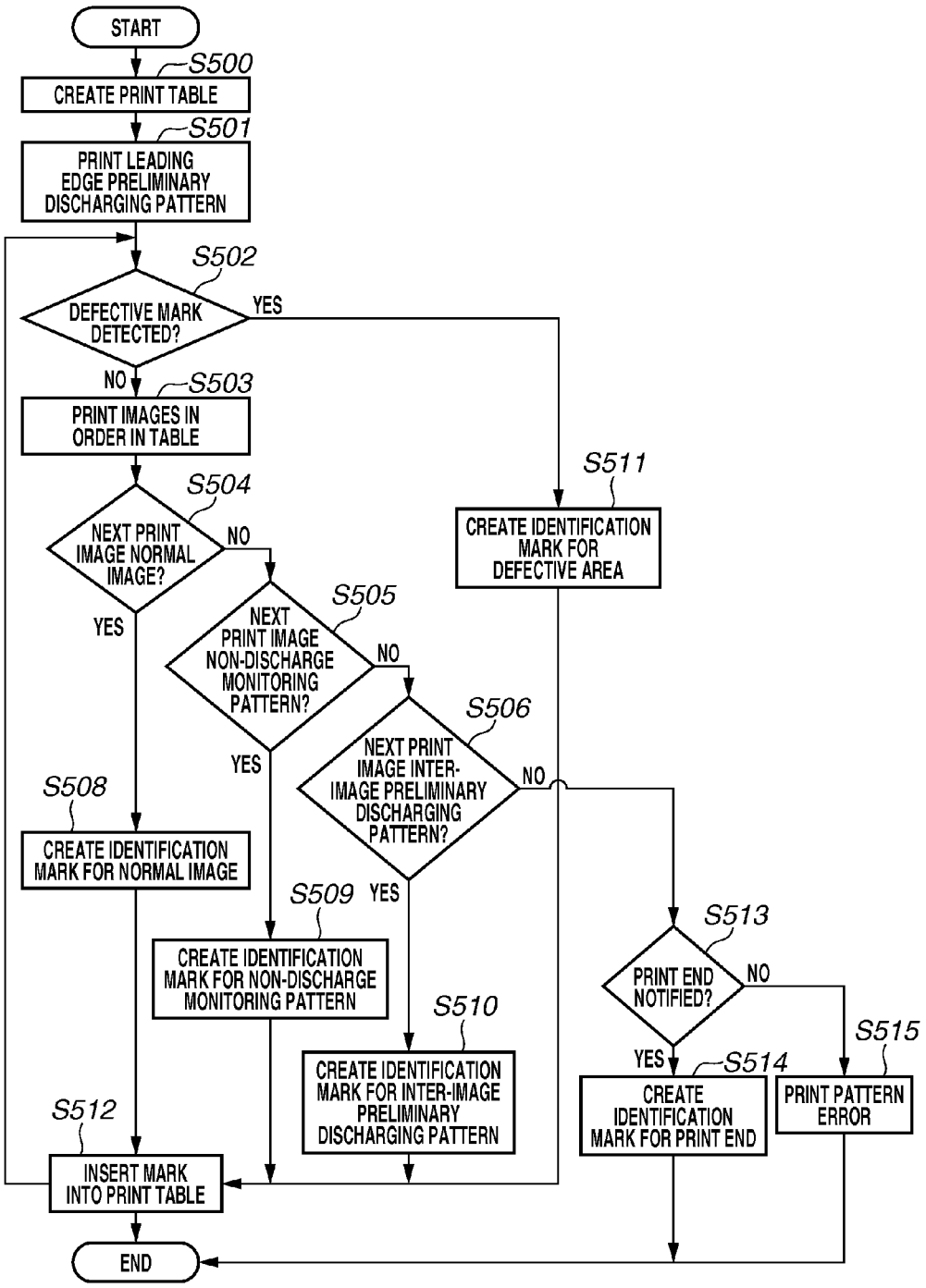
FIG. 5 is a flowchart of processing when a first printing apparatus in the print system according to the exemplary embodiment performs printing on a first surface.

FIG. 5 is a flowchart illustrating processing performed when an identification mark is inserted into a print image on a first surface by the first printing apparatus. The processing is executed by the CPU 311 in the first printing apparatus 119 loading a program stored in the ROM 312 in the RAM 313.

In step S500, a print table describing which images are to be printed in what order is created so as to perform printing on a first surface. In step S501, when printing is started, a leading edge preliminary discharging pattern is first printed. In step S502, it is determined whether there is a defective area. In this step, determination of whether there is a defective area is made based on whether a defective mark is detected. If there is a defective area (YES in step S502), the processing proceeds to step S511, and an identification mark for a defective area is created. In step S512, the created identification mark is registered right before the defective area in the print table. Then, the processing returns to step S502. Accordingly, in step S503, the identification mark for the defective area is printed before the defective area. If there is not a defective area (No in step S502), the processing proceeds to step S503.

In step S503, images are printed in the order described in the print table.

In step S504, it is determined whether an image to be printed next is a normal image. According to the present exemplary embodiment, an image to be printed next is determined in this step, however, an image printed two or more images later may be determined. If the image to be printed next is a normal image (YES in step S504), the processing proceeds to step S508, and an identification mark for a normal image is created. In step S512, the created identification mark is registered right before the normal image in the print table. Then, the processing returns to step S502. Accordingly, in step S503, the identification mark for the normal image is printed before the normal image.

In step S504, if the image to be printed next is not a normal image (NO in step S504), then in step S505, it is determined whether the image to be printed next is a non-discharge monitoring pattern. In this step, determination of whether the image to be printed next is a non-discharge monitoring pattern is made based on whether a preliminary set number of lines is printed or not. According to the present exemplary embodiment, in the case where the number of lines will reach 30000 lines if a next normal image is printed, it is determined that the image to be printed next is a non-discharge monitoring pattern. If the image to be printed next is a non-discharge monitoring pattern (YES in step S505), the processing proceeds to step S509, and an identification mark for a non-discharge monitoring pattern is created. In step S512, the created identification mark is registered right before the non-discharge monitoring pattern in the print table. Then, the processing returns to step S502. Accordingly, in step S503, the identification mark for the non-discharge monitoring pattern is printed before the non-discharge monitoring pattern.

In step S505, if the image to be printed next is not a non-discharge monitoring pattern (NO in step S505), then in step S506, it is determined whether the image to be printed next is a preliminary discharging pattern between images. In this step, determination of whether the image to be printed next is a preliminary discharging pattern between images is made based on whether a preliminary set number of lines is printed. According to the present exemplary embodiment, in the case where the number of lines will reach 15000 lines if a next normal image is printed, it is determined that the image to be printed next is a non-discharge monitoring pattern. If the image to be printed next is a non-discharge monitoring pattern between images (YES in step S506), the processing proceeds to step S510, and an identification mark for a preliminary discharging pattern is created. In step S512, the created identification mark is registered right before the non-discharge monitoring pattern between images in the print table. Then, the processing returns to step S502. Accordingly, in step S503, the identification mark for the preliminary discharging pattern is printed before the preliminary discharging pattern between images.

In step S506, if the image to be printed next is not a preliminary discharging pattern (NO in step S506), then in step S513, it is confirmed whether print end is notified. If the print end is notified (YES in step S513), then in step S514, an identification mark for print end is created. In step S512, the created identification mark is registered at the bottom of the print table, and the processing is ended. In step S513, if the print end is not notified (NO in step S513), then in step S515, it is regarded as a print pattern error, and the processing is ended.

The processing order described in steps S504 to S506 is not limited to the above-described order, and any order can be taken.

Figure 6:
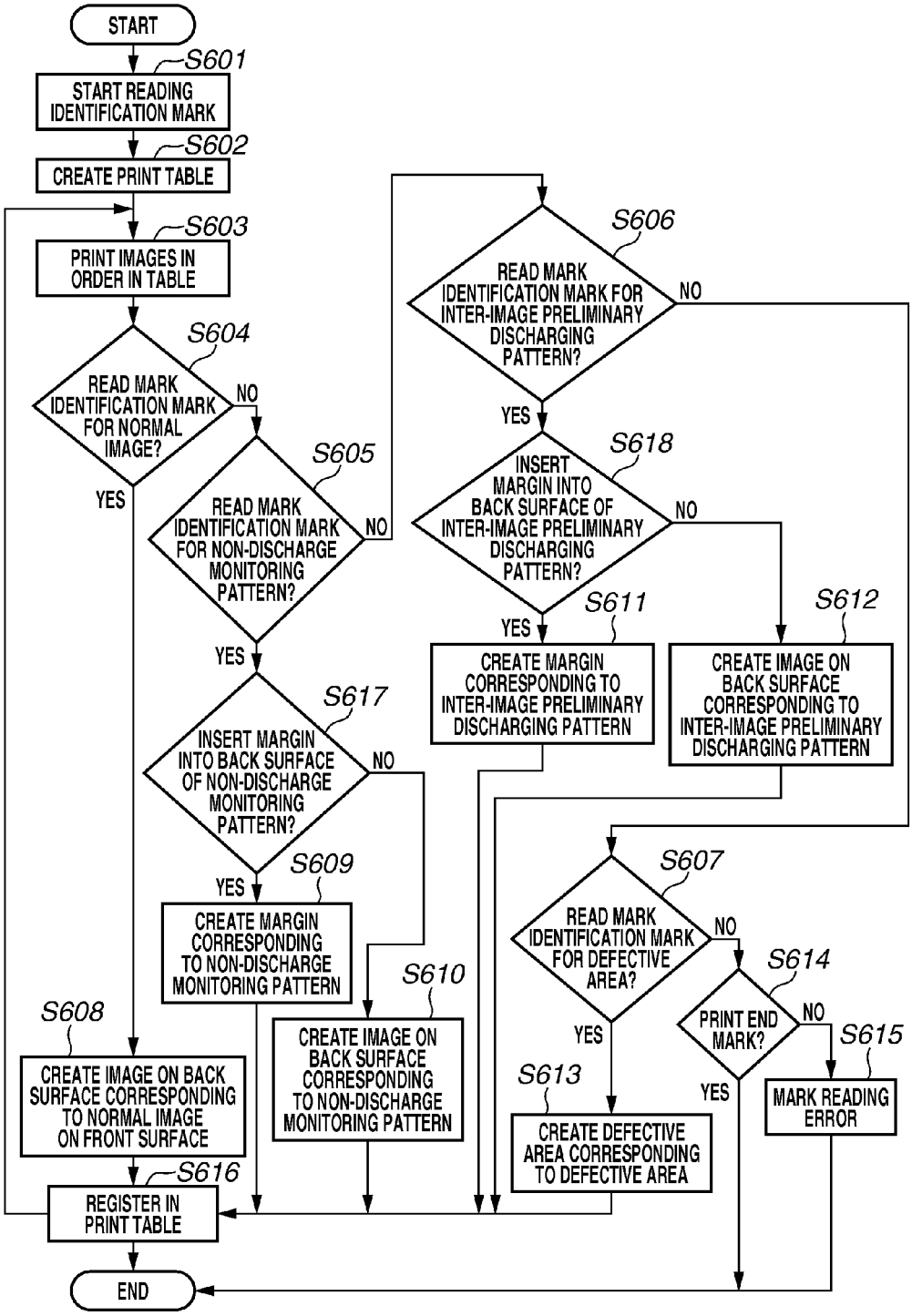
FIG. 6 is a flowchart of processing when a second printing apparatus in the print system according to the exemplary embodiment performs printing on a second surface.

FIG. 6 is a flowchart illustrating processing performed when the first printing apparatus 119 reads identification marks printed on a first surface of a continuous sheet and the second printing apparatus 120 generates an image to be printed on a second surface of the continuous sheet and prints the image. The processing is executed by the CPU 311 in the second printing apparatus 120 loading a program stored in the ROM 312 in the RAM 313.

First, in step S601, reading of an identification mark printed on a first surface is started. Next, in step S602, a print table is created. In step S602, a print table describing which images are to be printed in what order is created so as to perform printing on the second surface corresponding to printed images on the first surface. In step S603, images are printed in the order in the print table.

In step S604, it is confirmed whether a read identification mark is the identification mark for the normal image. If the read identification mark is the identification mark for the normal image (YES in step S604), then in step S608, a normal image corresponding to the first surface is created on the second surface. In step S616, the created normal image is registered in the print table, and then the processing returns to step S603.

In step S604, if the read identification mark is not the identification mark for the normal image (NO in step S604), then in step S605, it is confirmed whether the read identification mark is the identification mark for the non-discharge monitoring pattern. If the read identification mark is the identification mark for the non-discharge monitoring pattern (YES in step S605), the processing proceeds to step S617, and it is determined whether a margin is set to be inserted into the second surface in the case where the non-discharge monitoring pattern is printed on the first surface. If a margin is set to be inserted (YES in step S617), then in step S609, a margin of which length is similar to that of the non-discharge monitoring pattern on the first surface is created. In step S616, the created margin is registered in the print table, and then the processing returns to step S603. In step S617, if a margin is not set to be inserted (NO in step S617), then in step S610, a non-discharge monitoring pattern similar to the non-discharge monitoring pattern on the first surface is created. In step S616, the created non-discharge monitoring pattern is registered in the print table, and then the processing returns to step S603.

In step S605, if the read identification mark is not the identification mark for the non-discharge monitoring pattern (NO in step S605), then in step S606, it is determined whether the read identification mark is an identification mark for a preliminary discharging pattern. If the read identification mark is the identification mark for the preliminary discharging pattern (YES in step S606), then in step S618, it is confirmed whether a margin is set to be inserted into the second surface in the case where the preliminary discharging pattern is printed on the first surface. If a margin is set to be inserted (YES in step S618), then in step S611, a margin of which length is similar to that of the preliminary discharging pattern on the first surface is created. In step S616, the created margin is registered in the print table, and then the processing returns to step S603. In step S618, if a margin is not set to be inserted (NO in step S618), then in step S612, a preliminary discharging pattern similar to the preliminary discharging pattern between images on the first surface is created. In step S616, the created preliminary discharging pattern is registered in the print table, and then the processing returns to step S603.

In step S606, if the read identification mark is not the identification mark for the preliminary discharging pattern between images (NO in step S606), then in step S607, it is confirmed whether the read identification mark is an identification mark for a defective area. If the read identification mark is the identification mark for the defective area (YES in step S607), then in step S613, a defective area of which length is similar to that of the defective area on the first surface is created. In step S616, the created defective area is registered in the print table, and then the processing returns to step S603.

In step S607, if the read identification mark is not the identification mark for the defective area (NO in step S607), in step S614, it is confirmed whether the read identification mark is a print end mark. If the read identification mark is the print end mark (YES in step S614), printing is ended. If the read identification mark is not the print end mark (NO in step S614), it is considered that the identification mark is recognized but cannot be identified whether a normal image or a control pattern, so that in step S615, it is regarded as a mark reading error.

Figure 7:
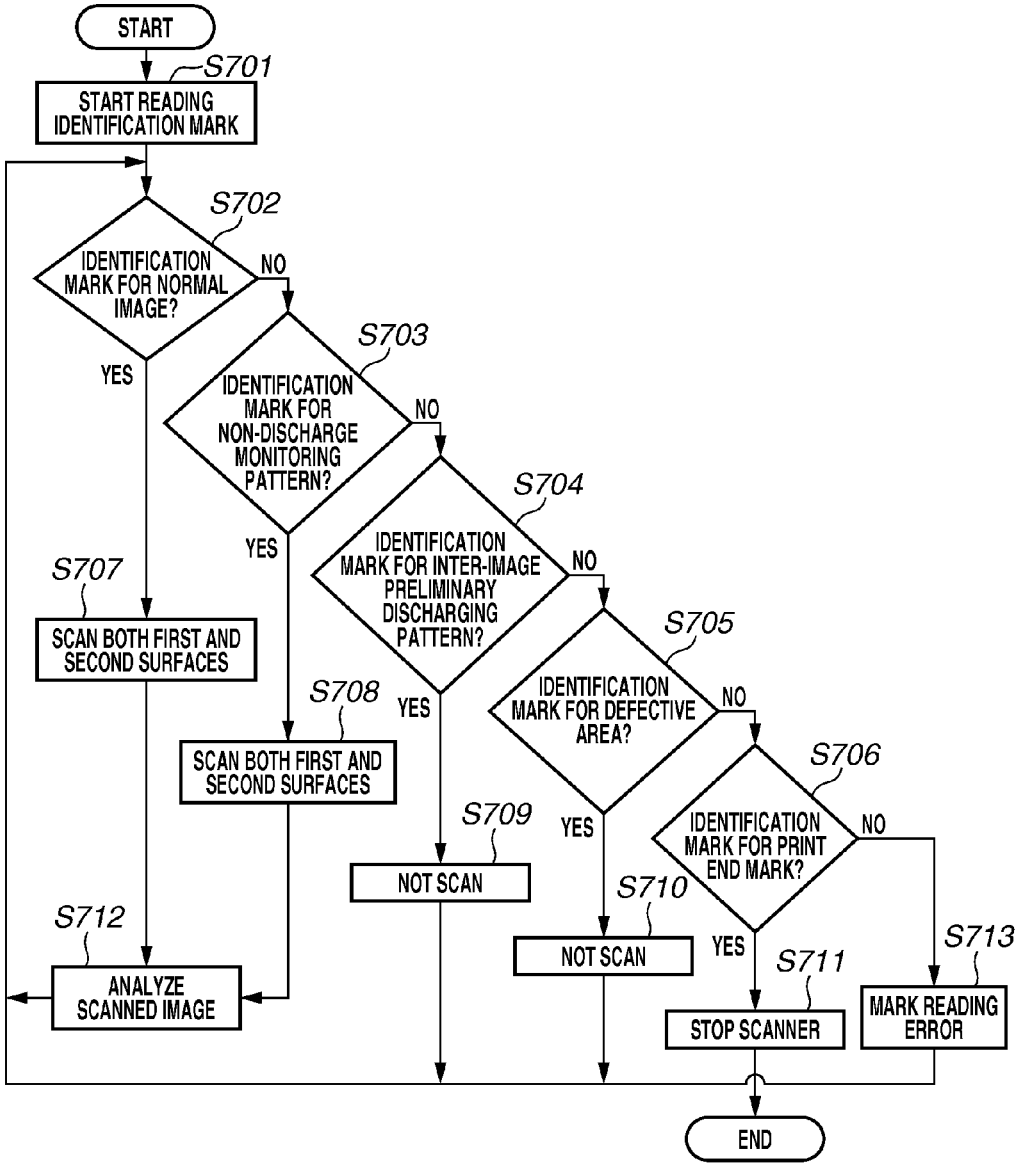
FIG. 7 is a flowchart of processing when the print system according to the exemplary embodiment performs scanning.

FIG. 7 is a flowchart illustrating processing performed when the scanner unit 115 reads an identification mark printed on a first surface and determines an image to scan. The processing is executed by a CPU, which is not illustrated, in the scanner unit 115.

In step S701, the CPU starts reading of an identification mark. In step S702, the CPU determines whether a read identification mark is an identification mark for a normal image. If the read identification mark is the identification mark for the normal image (YES in step S702), the processing proceeds to step S707, and the CPU scans images on both of a first surface and a second surface. In step S712, the CPU analyzes scanned images on the first surface and the second surface, and then, the processing returns to step S702.

In step S702, if the read identification mark is not the identification mark for the normal image (NO in step S702), then in step S703, the CPU determines whether the read identification mark is an identification mark for a non-discharge monitoring pattern. If the read identification mark is the identification mark for the non-discharge monitoring pattern (YES in step S703), the processing proceeds to step S708, and the CPU scans images on both of the first surface and the second surface. In step S712, the CPU analyzes scanned images, and then, the processing returns to step S702.

In step S703, if the read identification mark is not the identification mark for the non-discharge monitoring pattern (NO in step S703), then in step S704, the CPU determines whether the read identification mark is an identification mark for a preliminary discharging pattern between images. If the read identification mark is the identification mark for the preliminary discharging pattern (YES in step S704), then in step S709, scanning is not performed, and the processing returns to step S702 by skipping the processing in step S712.

In step S704, if the read identification mark is not the identification mark for the preliminary discharging pattern (NO in step S704), then in step S705, the CPU determines whether the read identification mark is an identification mark for a defective area. If the read identification mark is the identification mark for the defective area (YES in step S705), then in step S710, scanning is not performed, and the processing returns to step S702 by skipping the processing in step S712.

In step S705, if the read identification mark is not the identification mark for the defective area (NO in step S705), then in step S706, the CPU confirms whether the identification mark is a print end mark. If the identification mark is the print end mark (YES in step S706), then in step S711, the CPU stops the scanner unit and ends the processing. In step S706, if the identification mark is the print end mark (NO in step S706), it is considered that the read mark is an undefined mark. Therefore, it is regarded as a mark reading error and the processing returns to step S702.

According to the present exemplary embodiment, the scanner unit 115 reads a print control mark printed by the first printing apparatus 119 and can perform scanning only when the read print control mark includes information about a normal image and a non-discharge monitoring pattern, in other words, only specified image can be scanned.

Figure 8:
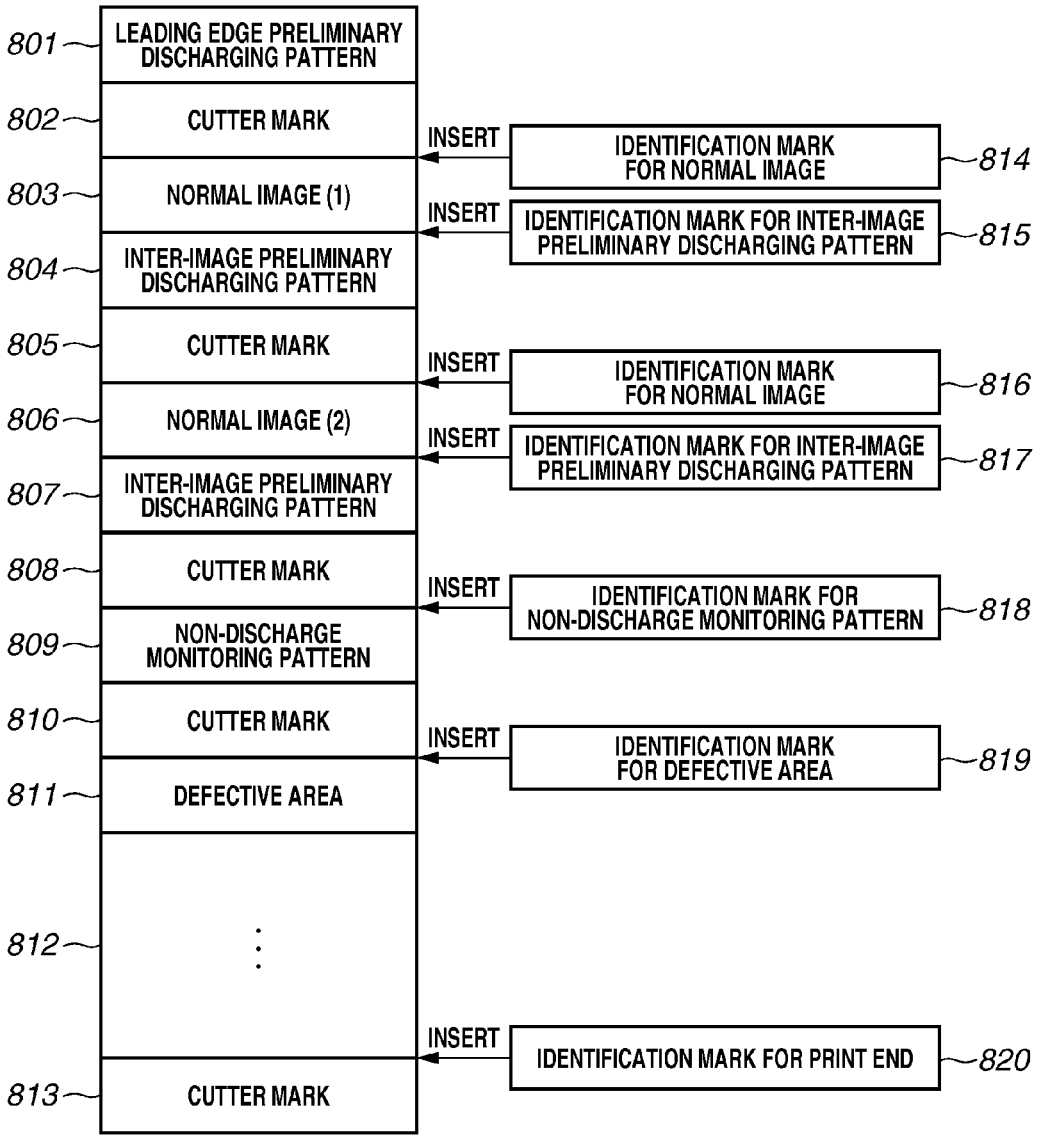
FIG. 8 is an example of a print table created by the first printing apparatus in the print system according to the exemplary embodiment.

FIG. 8 is an example of a print table to be created according to a printing order of images when the first printing apparatus prints images on a first surface. As described above, the first printing apparatus 119 causes the CPU 311 to create an information table describing that the printing apparatus prints which images in what order on the RAM 313 and performs printing according to the created print table. FIG. 8 illustrates a print table to be created based on the printing order illustrated in FIG. 5. A leading edge preliminary discharging pattern 801 is inserted into the print table. A leading edge preliminary discharging pattern is always inserted into a leading edge of a sheet. A cutter mark 802 is inserted for cutting the leading edge preliminary discharging pattern 801. A normal image (1) 803 which is input from the controller 117 is inserted. An identification mark for a normal image 814 is inserted right before the normal image (1) 803. An inter-image preliminary discharging pattern 804 is inserted. An identification mark for an inter-image preliminary discharging pattern 815 is inserted right before the inter-image preliminary discharging pattern 804. A cutter mark 805 is inserted for cutting the inter-image preliminary discharging pattern 804. A normal image (2) 806 which is input from the controller 117 is inserted. An identification mark for a normal image 816 is inserted right before the normal image (2) 806. An inter-image preliminary discharging pattern 807 is inserted. An identification mark for an inter-image preliminary discharging pattern 817 is inserted right before the inter-image preliminary discharging pattern 807. A cutter mark 808 is inserted for cutting the inter-image preliminary discharging pattern 807. A non-discharge monitoring pattern 809 is inserted. An identification mark for a non-discharge monitoring pattern 818 is inserted right before the non-discharge monitoring pattern 809. A cutter mark 810 is inserted for cutting the non-discharge monitoring pattern 809. When a defective mark is detected during printing, a margin corresponding to a defective area 811 is inserted. An identification mark for a defective area 819 is inserted right before the defective area 811. Then, normal images and the control patterns including the inter-image preliminary discharging pattern, the non-discharge monitoring pattern, and the defective area which are printed afterward are inserted into a portion 812 in the print table. A cutter mark 813 is inserted at the point of a print end, and an identification mark for print end 820 is inserted right before the last cutter mark. The first printing apparatus 119 prints images in the order registered in the print table.

According to the present exemplary embodiment, such print control marks 814, 815, 816, 817, 818, and 819 which distinguish a normal image from the control pattern are printed on a first surface at the time of printing, and the second printing apparatus reads the print control marks. Thus, the second printing apparatus determines an image to print, such as whether an image printed on the second surface corresponding to the first surface is a normal image, a control pattern, or insertion of a margin.

Figure 9:
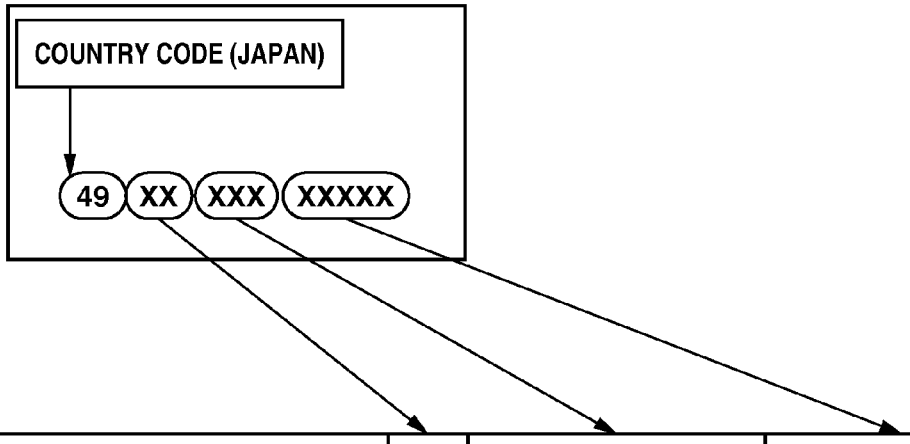
FIG. 9 is an example of specifications of identification marks.

FIG. 9 is an example of specifications of identification marks.

According to the present exemplary embodiment, a bar code is used to identify a normal image and a control pattern. A bar code uses, for example, 13 digits (assuming the European Article Number (EAN) code, which is used as a common commodity code worldwide), and first two digits are used for a country code. In FIG. 9, Japan's country code 49 is input, for example. For other countries, the country code may be changed according to a destination of an apparatus, such as "00" for United State, "30" for France, and "40" for Germany. Next two digits are used for a code identifying a type of a normal image and control patterns. Values "00" means a normal image, "01" means an inter-image preliminary discharging pattern, "02" means a non-discharge monitoring pattern, "03" means a defective area, and "04" means print end. Next three digits are used for a code of a page number to be printed on a first surface when normal images are printed. Last five digits are used for a code of the number of lines of a length of an image to be printed in terms of 600 dpi. According to the present exemplary embodiment, the number of lines is confirmed by the last five digits, and a length of an image to be printed and a length to insert a margin are confirmed. In a bar code shown as an example in FIG. 9, the country code 49 means Japan, the next two digits 00 means a normal image, and the next three digits 001 means that an image on a page having a page number one is printed on a first surface. In the last five digits, information indicating 15000 lines (a length of image in terms of 600 dpi: about 25 inches) is input. According to the present exemplary embodiment, types of a normal image and control patterns are identified using a one-dimensional bar code, however, the identification method is not limited to the above-described example. For example, a two-dimensional bar code, such as a quick response (QR) code (registered trademark), or other pattern marks may be used.

According to the present exemplary embodiment, a normal image can be arranged at an appropriate position on a second surface even if control patterns, such as a non-discharge monitoring pattern, a preliminary discharging pattern, and a defective area, of which timing to be inserted into a first surface cannot be predicted are irregularly inserted. In other words, images on a first surface and on a second surface and their positions can be adjusted to match with each other.

In this regard, if a control pattern image is printed during printing of a normal image in the case where an identification mark for identifying the control pattern image is not inserted, scheduling information needs to be transmitted to adjust positions of the first surface and the second surface. More specifically, the first printing apparatus creates scheduling information indicating which part of a first surface a control pattern image is inserted and printed and transmits the scheduling information to the second printing apparatus, and the second printing apparatus reschedules print contents on a second surface according to the transmitted scheduling information. On the other hand, according to the present exemplary embodiment, the first printing apparatus 119 prints an identification mark capable of identifying a normal image and a control image, and thus can handle a pattern image (i.e., the control image) which is irregularly inserted and other than an image based on image data. In other words, according to the present exemplary embodiment, an identification mark for identifying a control image is inserted every time the first printing apparatus 119 prints the control image in consideration of printing of control images, such as a preliminary discharging pattern and a non-discharge monitoring pattern, which are unpredictably and irregularly inserted into a first surface. Further, when the second printing apparatus 120 performs printing, the second printing apparatus 120 determines an image to print based on the identification mark. Accordingly, the first printing apparatus 119 does not need to create and transmit scheduling information to the second printing apparatus 120, and the second printing apparatus 120 does not need to reschedule printing of a second surface according to contents printed on a first surface of a continuous sheet. Therefore, a processing load of the second printing apparatus 120 can be reduced.

A basic configuration of the present invention is not limited to the above-described configuration. The above-described exemplary embodiment is a means of achieving the effects of the present invention, and when an equivalent effect of the present invention can be achieved by using other similar methods and different parameters, those methods and parameters are included in the scope of the present invention.

For example, a timing to insert a control image, such as a preliminary discharging pattern and a non-discharge monitoring pattern is not limited to be based on the number of print lines, and may be based on, for example, a discharge amount of a recording agent. In this case, an amount of a recording agent discharged by the first printing apparatus does not always coincide with an amount of a recording agent discharged by the second printing apparatus. However, the respective printing apparatuses print images of the same size, so that the discharge amounts of the recording agents are in the same range. In addition, the amount of the recording agent discharged by the first printing apparatus is sometimes slightly larger than the amount of the recording agent discharged by the second printing apparatus, because the first printing apparatus prints control patterns. However, an amount of a recording agent used for the control pattern is very small as compared with that of a normal image. Therefore, any problem will not occur if the second printing apparatus inserts the control image based on the amount of the recording agent discharged by the first printing apparatus.

Further, which pattern is inserted into a second surface of a continuous sheet in which printing on first surface thereof has been finished is not limited to the above-described example. According to the present exemplary embodiment, it is described that when a control pattern is printed on the first surface, a similar control pattern is printed on the second surface, however, the configuration is not limited to the above-described one. For example, an inter-image preliminary discharging pattern may be printed on the first surface, and a non-discharge monitoring pattern may be printed on the second surface. According to the above-described exemplary embodiment, an identification mark can identify a type of a control image, however, an identification mark may identify only whether a control image or not. In such a case, it may be set to allow printing of the control image in a portion of a control pattern including the control image.

Further, according to the above-described exemplary embodiment, the first printing apparatus 119 determines whether to insert an identification mark for identifying a printed control image on a first surface of a sheet, however, the configuration is not limited to the above-described one. For example, the control flow illustrated in FIG. 5 may be executed by the controller 117. More specifically, the controller 117 may control the first printing apparatus 119 to insert (print) a predetermined identification mark.

According to the above-described exemplary embodiment, the second printing apparatus 120 reads an image on a continuous sheet and determines an image to be printed on a second surface of the continuous sheet, however, the configuration is not limited to the above-described one. For example, the control flow illustrated in FIG. 6 may be executed by the controller 117. In addition, only reading image may be performed by the first printing apparatus 119 or other apparatuses.

Further, according to the above-described exemplary embodiment, the first printing apparatus 119 and the second printing apparatus 120 execute printing. However, the present invention can be applied to a configuration in which printing is executed by a single printing apparatus provided with two printer engines. In other words, the present invention can be applied to a single printing apparatus provided with a first printing unit and a second printing unit. In this case, the printing apparatus includes, for example, two printer engines and may determine whether to insert an identification mark for identifying a control image printed by the first printing unit into a first surface of a sheet, or an apparatus externally provided may determine whether to insert the identification mark on the first surface of the sheet.

The present invention can also be realized by executing the following processing. More specifically, software (a program) for realizing the functions of the above-described exemplary embodiments is supplied to a system or an apparatus via a network or various storage media and a computer (or CPU or a MPU) of the system or the apparatus reads and executes the program. Further, the program may be executed by a single computer or a plurality of computers interlocking with one another. In addition, the above-described processing does not need to be entirely realized by the software, and a part or the whole the processing may be realized by hardware. Further, the CPU is not limited to the one which executes entire processing by a single CPU, and a plurality of CPUs may execute the processing in cooperation with each other appropriately.

According to the present invention, positions of a first surface and a second surface can be adjusted when a control pattern or the like is irregularly inserted. Further, if an image other than an image based on image data is irregularly inserted when the first printing apparatus performs printing on the first surface, there is no need to reschedule images on the second surface, so that a processing load to the apparatus can be reduced and consistency between images on the first surface and the second surface can be achieved.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269675, filed Dec. 26, 2013, which is hereby incorporated by reference herein in its entirety.

What is claimed is:

1. A control apparatus included in a print system comprising a first printing unit configured to print a plurality of images based on image data on a first surface of a continuous sheet, a reading unit, and a second printing unit configured to print a plurality of images based on image data on a second surface of the continuous sheet, the control apparatus comprising:

a first control unit configured to, in the case where the first printing unit prints a control image irregularly inserted between the images based on the image data on the first surface of the continuous sheet, cause the first printing unit to print an identification mark which enables the control image to be identified on the first surface of the continuous sheet; and a second control unit configured to, in the case where the reading unit reads the identification mark printed on the first surface of the continuous sheet, control the second printing unit not to print the image based on the image data in an area corresponding to the control image printed on the first surface of the continuous sheet when the second printing unit performs printing on the second surface of the continuous sheet.

2. The control apparatus according to claim 1, wherein, in the case where the reading unit reads the identification mark printed on the first surface of the continuous sheet, the second control unit controls the second printing unit not to perform printing in an area corresponding to the identification mark printed on the first surface of the continuous sheet.

3. The control apparatus according to claim 1, wherein, in the case where the reading unit reads the identification mark printed on the first surface of the continuous sheet, the second control unit controls the second printing unit to print the control image for the second printing unit in an area corresponding to the control image printed on the first surface of the continuous sheet.

4. The control apparatus according to claim 1, wherein the first printing unit and/or the second printing unit performs printing by discharging a recording agent from a recording head, and the control image to be irregularly inserted includes at least one of a preliminary discharging pattern and a non-discharge monitoring pattern.

5. The control apparatus according to claim 1, wherein the identification mark is a mark capable of storing a plurality of information pieces therein.

6. The control apparatus according to claim 1 further comprising a third control unit configured to perform control of whether to cause a second reading unit to read an image printed on a continuous sheet based on an identification mark read by the reading unit.

7. The control apparatus according to claim 1, wherein the control apparatus comprises at least one of the first printing unit and the second printing unit.

8. The control apparatus according to claim 1, wherein the first printing unit is included in a first printing apparatus and the second printing unit is included in a second printing apparatus.

9. A printing system for executing a print on a first surface and a second surface of a continuous sheet, the printing system comprising:

a first printing apparatus including;

a first printing unit configured to print a plurality of images based on image data on a first surface of a continuous sheet; wherein the first printing unit prints, in a case where the first printing unit prints a control image irregularly inserted between the images based on the image data on the first surface of the continuous sheet, an identification mark which enables the control image to be identified on the first surface of the continuous sheet, a second printing apparatus including;

a reading unit configured to read an image;

a second printing unit configured to print a plurality of images based on image data on a second surface of the continuous sheet, wherein the second printing unit does not print, in the case where the reading unit reads an identification mark printed on the first surface of the continuous sheet, the image based on the image data in an area corresponding to the control image printed on the first surface of the continuous sheet when the second printing unit performs printing on the second surface of the continuous sheet.

10. A method for controlling a print system comprising a first printing unit configured to print a plurality of images based on image data on a first surface of a continuous sheet, a reading unit configured to read an image, and a second printing unit configured to print a plurality of images based on image data on a second surface of the continuous sheet, the method comprising:

causing, in the case where the first printing unit prints a control image which is irregularly inserted between the images based on the image data on the first surface of the continuous sheet, the first printing unit to print an identification mark which enables the control image to be identified on the first surface of the continuous sheet; and controlling, in the case where the reading unit reads an identification mark printed on the first surface of the continuous sheet, the second printing unit not to print the image based on the image data in an area corresponding to the control image printed on the continuous sheet when performing printing on the second surface of the continuous sheet.

11. A storage medium storing a program for causing a computer to execute the method according to claim 10.

* * * * *